US011768053B1

(12) United States Patent
Edelman

(10) Patent No.: US 11,768,053 B1
(45) Date of Patent: Sep. 26, 2023

(54) MULTI-CHAMBERED PRE-CHARGED PNEUMATIC AIR GUN

(71) Applicant: Alexander S. Edelman, Lattingtown, NY (US)

(72) Inventor: Alexander S. Edelman, Lattingtown, NY (US)

( * ) Notice: Subject to any disclaimer, the term of this patent is extended or adjusted under 35 U.S.C. 154(b) by 0 days.

(21) Appl. No.: 18/198,878

(22) Filed: May 18, 2023

(51) Int. Cl.
*F41B 11/00* (2013.01)
*F41B 11/62* (2013.01)
*F41B 11/723* (2013.01)
*F41B 11/64* (2013.01)

(52) U.S. Cl.
CPC ..... *F41B 11/62* (2013.01); *F41B 11/64* (2013.01); *F41B 11/723* (2013.01)

(58) Field of Classification Search
CPC ..... F41A 21/10; F41A 11/02; F41A 21/484; F41B 11/62; F41B 11/64; F41B 11/52; F41B 11/55; F41B 11/721; F41B 11/54; F41B 11/722; F41B 11/723; F41B 11/682
USPC ..... 124/73, 56, 41.1, 45, 49, 63, 71, 72, 74, 124/76, 82, 75, 77
See application file for complete search history.

(56) References Cited

U.S. PATENT DOCUMENTS 381,950 A 5/1888 Pratt
2,938,513 A 5/1960 Giss
3,370,581 A 2/1968 Hills et al.
4,770,153 A * 9/1988 Edelman ..... F41B 11/724 137/505.22
5,078,118 A 1/1992 Perrone
5,515,837 A * 5/1996 Nin ..... F41B 11/723 124/59
5,819,717 A 10/1998 Johnson et al.
6,247,995 B1 * 6/2001 Bryan ..... B05B 7/2472 435/189
7,954,413 B2 6/2011 Koth
8,322,329 B1 * 12/2012 Sikes ..... F41B 11/723 124/73
8,905,012 B2 12/2014 Zafer
2009/0056693 A1 * 3/2009 Pedicini ..... F41B 11/64 124/73
2013/0192577 A1 * 8/2013 Maeda ..... F41B 11/723 124/74
2014/0331984 A1 * 11/2014 Brahler, II ..... F41B 11/723 124/76

(Continued)

FOREIGN PATENT DOCUMENTS

CN 206160822 U 5/2017

*Primary Examiner* — Michael D David
(74) *Attorney, Agent, or Firm* — Collard & Roe, P.C.

(57) ABSTRACT

A pre-charged pneumatic air gun includes a barrel, a firing valve, a trigger assembly, a compressed gas storage tank, a first chamber, a larger second chamber and a compression piston movable within the first chamber and the second chamber. The compression piston is operable to increase a pressure in the first chamber to a final first chamber pressure greater than an initial first chamber pressure by sequentially opening a first fill valve with the second fill valve closed to allow compressed gas to flow into the first chamber then opening a second fill valve to allow the compressed gas to flow into the second chamber, thereby displacing the compression piston and further compressing the compressed gas in the first chamber to achieve the final first chamber pressure.

12 Claims, 10 Drawing Sheets

(56) References Cited

U.S. PATENT DOCUMENTS

| | | | | |
|---|---|---|---|---|
| 2015/0316345 | A1* | 11/2015 | Brahler, II | F41B 11/60<br>124/73 |
| 2017/0089664 | A1* | 3/2017 | Kras | F41B 11/73 |
| 2017/0299321 | A1* | 10/2017 | Lort | F41B 11/62 |
| 2018/0172392 | A1* | 6/2018 | Malheiros | F41B 11/723 |
| 2018/0195830 | A1* | 7/2018 | Malheiros | F41B 11/62 |

* cited by examiner

MULTI-CHAMBERED PRE-CHARGED PNEUMATIC AIR GUN

BACKGROUND OF THE INVENTION

Field of the Invention

The invention relates to a pre-charged pneumatic (PCP) air gun.

The Prior Art

PCP air guns are characterized by an attached high pressure air storage tank which allow for multiple shots without the need to re-pressurize the air gun from an outside pressure source after each shot. The power of existing PCP air guns is limited by the industry standard maximum pressure of air gun compressors and air storage cylinders. This maximum pressure may be for example approximately 4500 psi. The most powerful conventional air guns are capable of using this pressure for the first shot, however the pressure in the attached high pressure air storage tank drops with each successive shot, thereby reducing the accuracy, trajectory and impact energy of the PCP air gun.

Accordingly, a need exists for a PCP air gun which is capable of achieving higher pressures then existing PCP air guns and which is capable of achieving greater accuracy, improved trajectories and greater impact energy.

SUMMARY OF THE INVENTION

The invention relates to a pre-charged pneumatic (PCP) air gun. The invention may be implemented as a PCP smooth bore or rifled long air gun or air pistol or an air gun for firing arrows or any other projectile suitable for an air gun.

An advantage of a PCP air gun according to embodiments of the invention is the ability to achieve greater compressed gas pressure by including two high pressure chambers which allow the PCP air gun to develop greater power by boosting the pressure supplied to a first chamber by an attached high pressure storage tank (which pressure is limited by the external compressor or storage cylinder) using a second larger and fluidly connected chamber having an air operated piston.

BRIEF DESCRIPTION OF THE DRAWINGS

Other advantages, benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
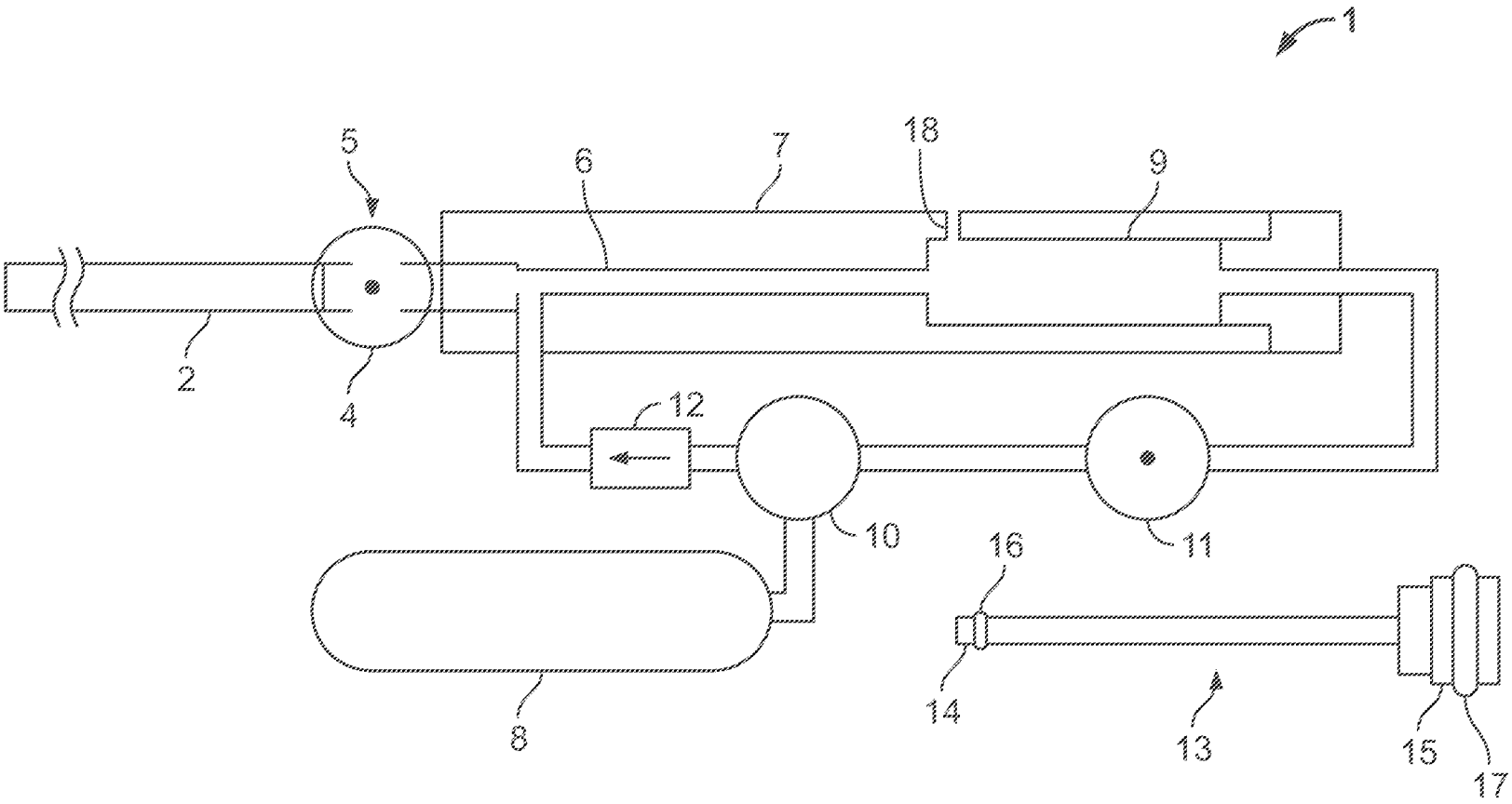
FIG. 1 is a schematic sectional view of a pre-charged pneumatic (PCP) air gun according to an embodiment of the invention.

Referring now in detail to the drawings, and in particular FIG. 1 is a schematic sectional view of a pre-charged pneumatic (PCP) air gun 1 according to an embodiment of the invention. The drawings figures illustrate the features of the PCP air gun only schematically and in practice the inventive PCP air gun may be implemented as a PCP smooth bore or rifled long air gun or air pistol or an air gun for firing arrows or any other projectile suitable for an air gun.

As shown, the PCP air gun 1 includes a barrel 2 through which a projectile 3 (See FIG. 5) is fired. A firing valve 4 is disposed in the barrel. Firing valve 4 may be a ball valve, a poppet valve or any other valve suitable for selectively allowing compressed gas to flow through barrel 2 for ejecting projectile 3 out an open end of barrel 2. The use of a ball valve is advantageous for a number of reasons, including the lower force required to open a ball valve as compared to conventional poppet valve, the provision of a continuous force due to the ball valve remaining open to release all of the compressed gas and the small travel required for an actuating mechanism due to the ball valve's 90° rotation between open and closed states.

The PCP air gun 1 further includes a trigger assembly 5 configured to actuate the firing valve 4. Trigger assembly 5 may include any trigger mechanism suitable to open firing valve 4 to release the compressed, boosted high pressure air from the first chamber 6 through the barrel 2 and propel the projectile 3 out of the barrel 2. Barrel 2 may include an integral chamber into which projectile 3 is inserted before firing.

The PCP air gun 1 may also include a frame or receiver 7 fixed to the barrel 2. The receiver 7 serves as a housing for the internal action components of the PCP air gun 1, such as for example, a bolt in a bolt-action PCP air gun 1.

The PCP air gun 1 further includes a compressed gas storage tank 8 containing a compressed gas. Compressed gas storage tank 8 may be disposed at a rear portion of receiver 7 in the case of a long air gun or in a handle portion in the case of an air pistol. Compressed gas storage tank 8 is supplied with compressed gas from a compressor or storage cylinders.

As schematically shown, a first chamber 6 is fluidly coupled to the barrel 2 and to the compressed gas storage tank 8. First chamber 6 has a first volume corresponding to its internal space or capacity. A second chamber 9 is also fluidly coupled to the compressed gas storage tank 8. Second chamber 9 has a second volume corresponding to its internal space or capacity. The second volume of second chamber 9 is greater than the first volume of first chamber 6. For example, the second volume of second chamber 9 may be multiple or many times greater than the first volume of first chamber 6. Second chamber 9 may have a vent 18.

As shown schematically, a first fill valve 10 is disposed between the compressed gas storage tank 8 and the first chamber 6 and is configured to selectively allow the compressed gas to flow from the compressed gas storage tank 8 to the first chamber 6. First fill valve 10 may be a ball valve or any other valve suitable for selectively allowing compressed gas to flow from the compressed gas storage tank 8 to the first chamber 6. A check valve 12 may be disposed between the first fill valve 10 and the first chamber 6.

A second fill valve 11 is disposed between compressed gas storage tank 8 and the second chamber 9 and is configured to configured to selectively allow the compressed gas to flow from the compressed gas storage tank 8 to the second chamber 9. Second fill valve 11 may be a ball valve or any other valve suitable for selectively allowing compressed gas to flow from the compressed gas storage tank 8 to the second chamber 9.

As shown schematically in the embodiment of FIGS. 1-5, the PCP air gun 1 has a compression piston 13 movable within the first chamber 6 and the second chamber 9. The compression piston 13 includes a first portion 14 sealingly engaged with the first chamber 6 and a second portion 15 sealingly engaged with the second chamber 9. The sealing engagement of the compression piston 13 with the chambers 6, 9 may be facilitated by one or more O-rings installed on various portions of the compression piston 13. For example, a first O-ring 16 may be disposed on the first portion 14 of the compression piston 13 and a second O-ring 17 may be disposed on the second portion 15 of the compression piston 13.

As shown schematically in FIGS. 2-5, the compression piston 13 is operable to increase a pressure of the compressed gas in the first chamber 6 to a final first chamber pressure greater than an initial first chamber pressure by sequentially opening the first fill valve 10 with the second fill valve 11 closed to allow the compressed gas to flow from the compressed gas storage tank 8 to the first chamber 6 and achieve the initial first chamber pressure and then opening the second fill valve 11 to allow the compressed gas to flow from the compressed gas storage tank 8 to the second chamber 9, thereby displacing the compression piston 13 and further compressing the compressed gas in the first chamber 6 to achieve the final first chamber pressure. In this manner, pressure increases of over 35% may be achieved.

Figure 2:
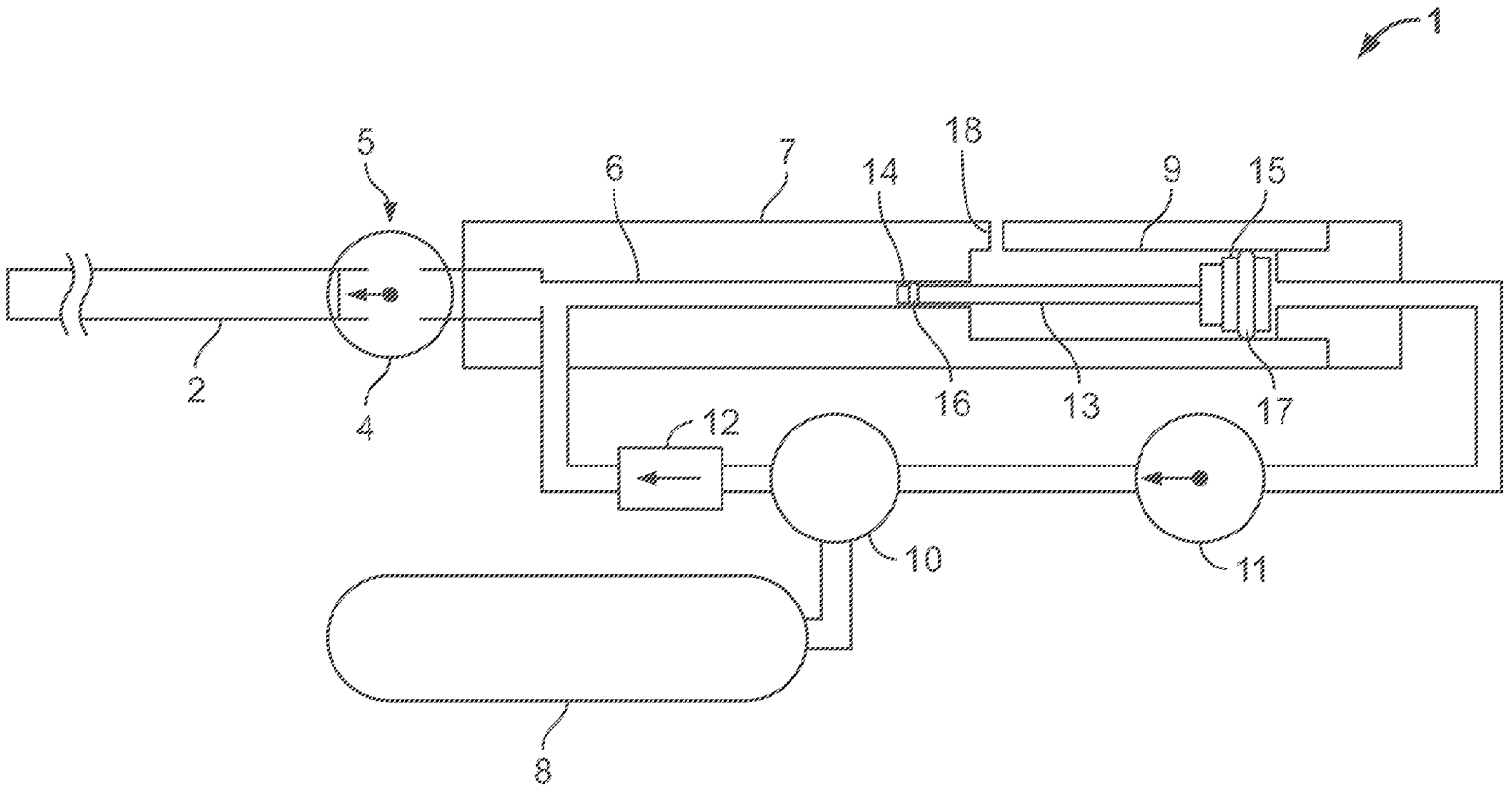
FIG. 2 is a schematic sectional view of the PCP air gun according to FIG. 1 in a post firing condition.

In particular, FIG. 2 schematically shows a PCP air gun 1 in a first condition which represents a post firing condition wherein all of the compressed gas from the first chamber 6 has been released out of the barrel 2 for firing a projectile 3. Both firing valve 4 and second fill valve 11 are in an open position or state, allowing compressed gas to flow therethrough.

Figure 3:
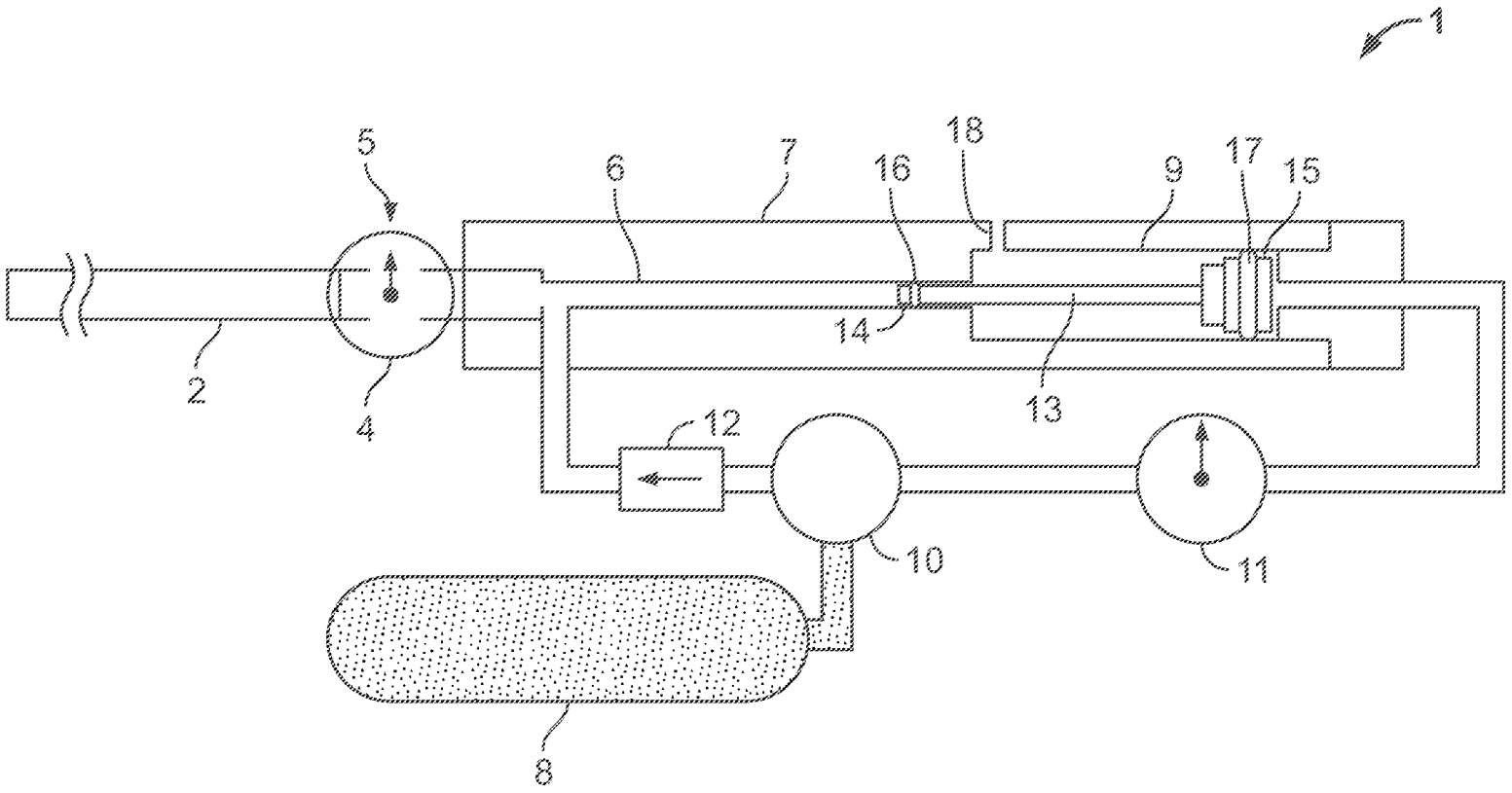
FIG. 3 is a schematic sectional view of the PCP air gun according to FIG. 1 in a condition preparing to fire a projectile.

FIG. 3 schematically shows the PCP air gun 1 in a second condition which represents a condition in preparation for firing a projectile 3. The firing valve 4 is in a closed position or state. The first fill valve 10 is opened while the second fill valve 11 remains closed, thereby allowing compressed gas to flow from the compressed gas storage tank 8 into the smaller, first chamber 6. At this time, no compressed gas is supplied to the larger, second chamber 9.

Figure 4:
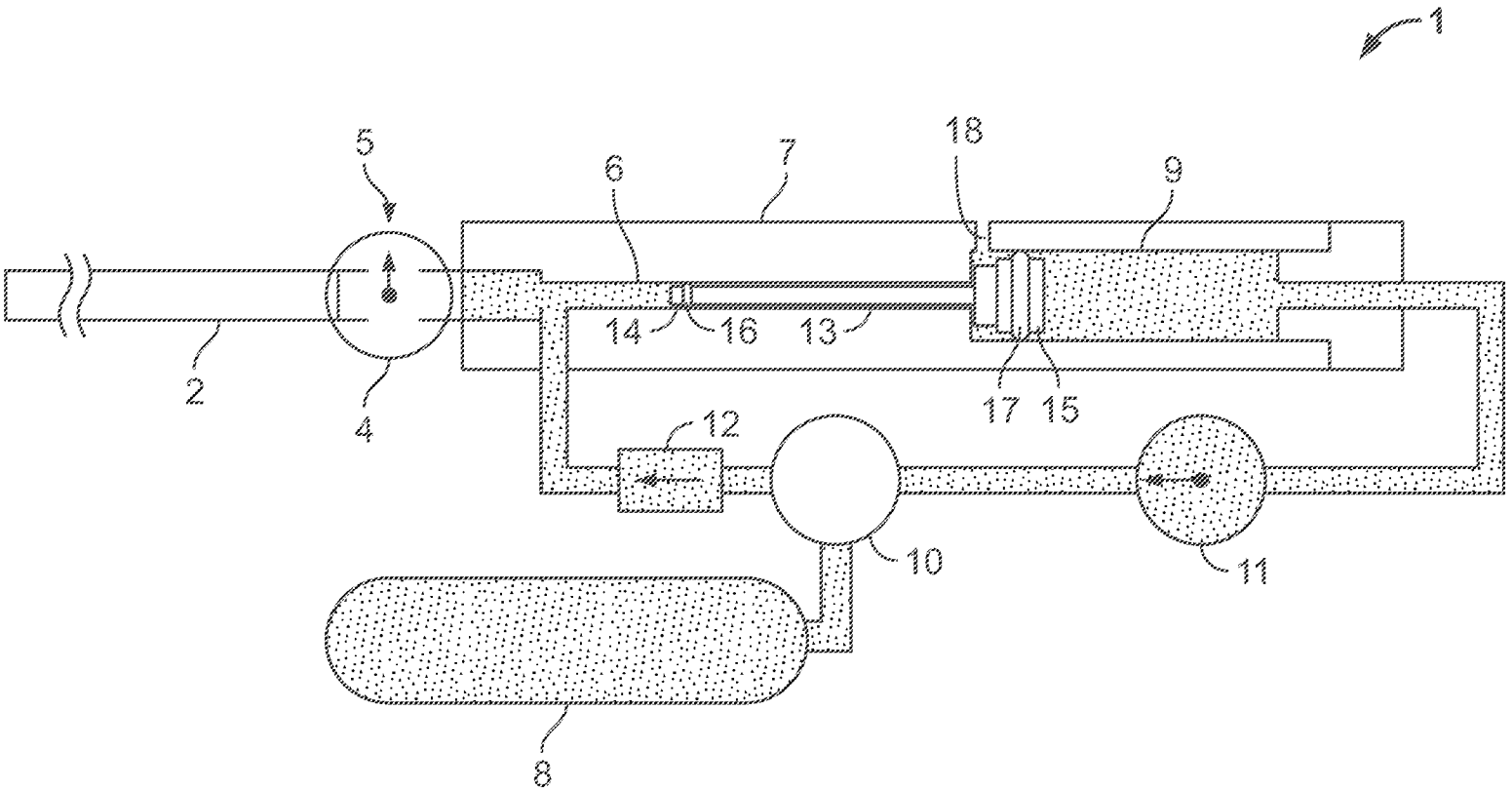
FIG. 4 is a schematic sectional view of the PCP air gun according to FIG. 1 in a subsequent condition preparing to fire the projectile.

FIG. 4 schematically shows the PCP air gun 1 in a third condition which represents a subsequent condition in preparation for firing projectile 3. Second fill valve 11 is opened, thereby allowing compressed gas to flow from the compressed storage tank 8 into the larger, second chamber 9. Because the area of the compression piston 13 in the second chamber 9 is larger, and even many times larger, than the area of the compression piston 13 in the first chamber 6, the introduction of the compressed gas into the second chamber 9 causes the compression piston 13 to move toward the smaller, first chamber 6. This movement further compresses the compressed gas in the first chamber 6 to achieve a final first chamber pressure which is greater than the initial first chamber pressure as provided by the compressed gas storage tank 8. Thus, the initial first chamber pressure is present in the condition illustrated in FIG. 3, wherein the final first chamber pressure is present in the condition illustrated in FIG. 4.

Figure 5:
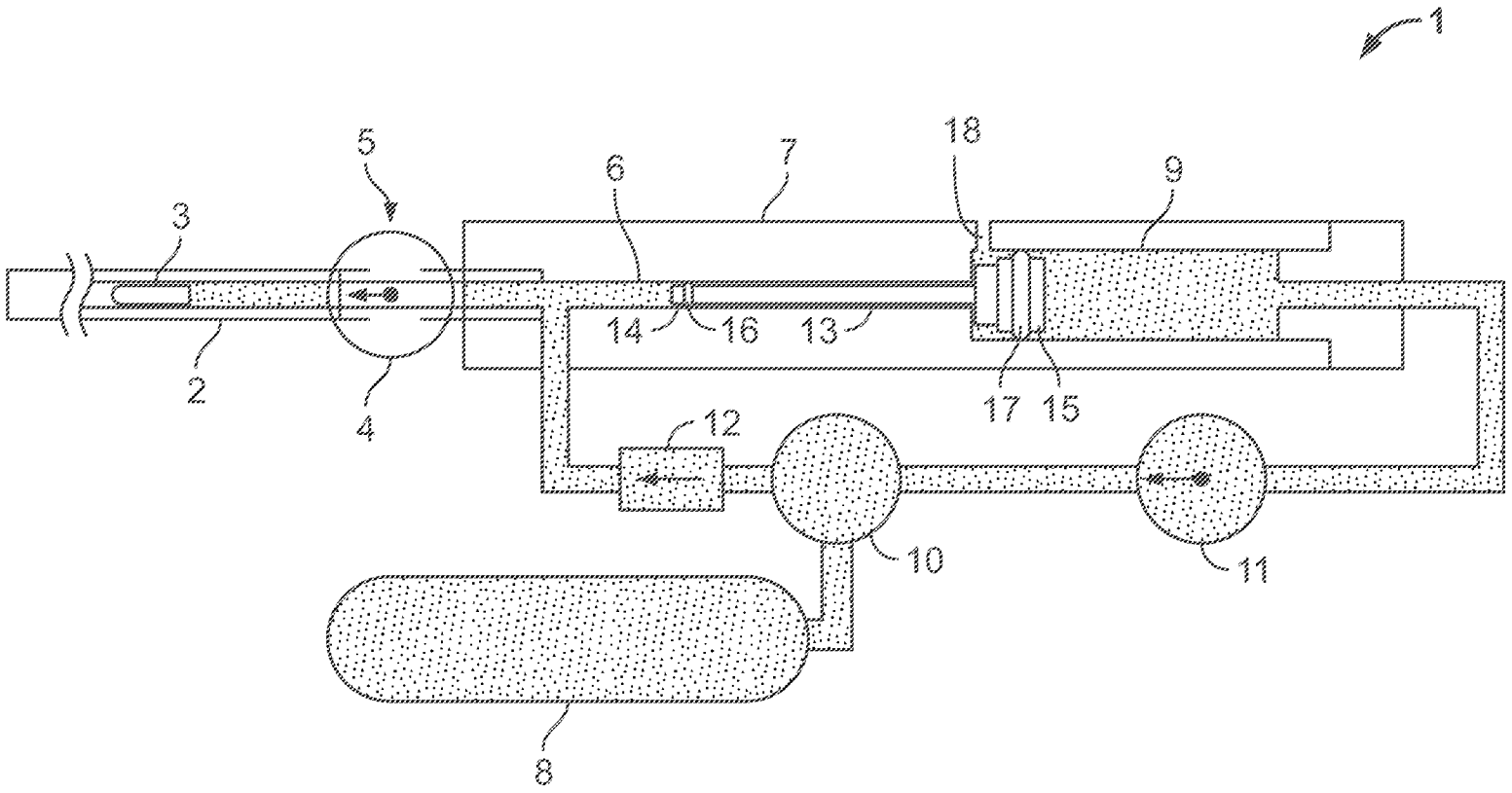
FIG. 5 is a schematic sectional view of the PCP air gun according to FIG. 1 in a condition wherein a trigger has actuated a firing valve to fire the projectile.
Figure 6:
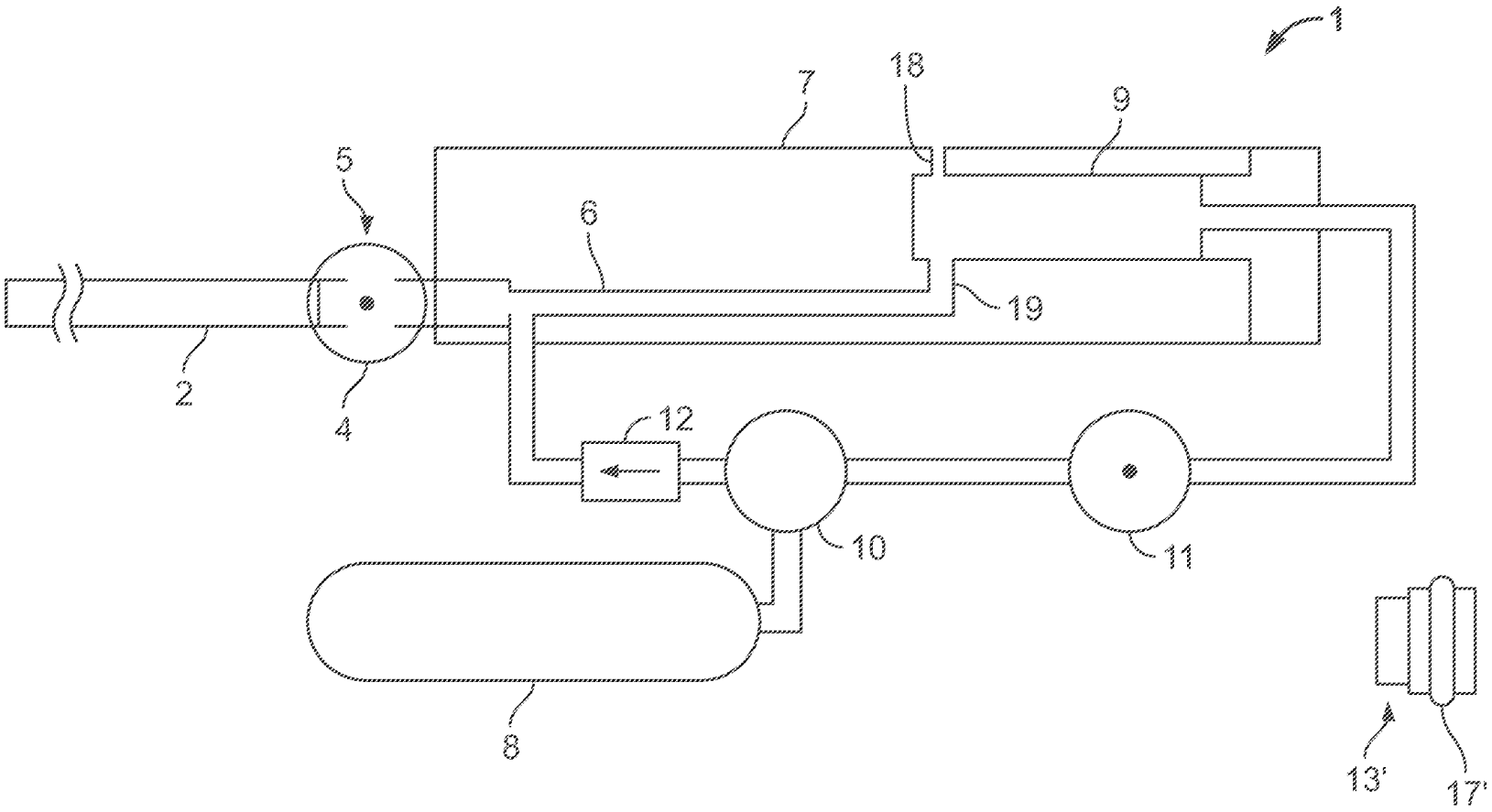
FIG. 6 is a schematic sectional view of a pre-charged pneumatic (PCP) air gun according to another embodiment of the invention.

FIG. 5 schematically shows the PCP air gun 1 in a fourth condition which represents a firing condition in which the trigger assembly 5 has been pulled, causing the firing valve 4 to open. This allows the compressed and boosted gas from the first chamber 6 to be released out of the barrel 2, followed by the compressed gas in the second chamber 9, which propels projectile 3 out of the barrel 2 at high velocity. Following the fourth condition illustrated schematically in FIG. 5, the PCP air gun 1 returns to the first condition illustrated schematically in FIG. 2.

FIGS. 6-10 are schematic sectional views of a PCP air gun 1 according to another embodiment of the invention. Similar to the previously described embodiment, the PCP air gun 1 includes a barrel 2 through which a projectile 3 (See FIG. 10) is fired. A firing valve 4 is disposed in the barrel. Firing valve 4 may be a ball valve, a poppet valve or any other valve suitable for selectively allowing compressed gas to flow through barrel 2 for ejecting projectile 3 out an open end of barrel 2.

The PCP air gun 1 further includes a trigger assembly 5 configured to actuate the firing valve 4. Trigger assembly 5 may include any trigger mechanism suitable to open firing valve 4 to release the compressed, boosted high pressure air from the first chamber 6 through the barrel 2 and propel the projectile 3 out of the barrel 2. Barrel 2 may include an integral chamber into which projectile 3 is inserted before firing.

The PCP air gun 1 may also include a frame or receiver 7 fixed to the barrel 2. The receiver 7 serves as a housing for the internal action components of the PCP air gun 1, such as for example, a bolt in a bolt-action PCP air gun 1.

The PCP air gun 1 further includes a compressed gas storage tank 8 containing a compressed gas. Compressed gas storage tank 8 may be disposed at a rear portion of receiver 7 in the case of a long air gun or in a handle portion in the case of an air pistol. Compressed gas storage tank 8 is supplied with compressed gas from a compressor or storage cylinders.

As schematically shown, a first chamber 6 is fluidly coupled to the barrel 2 and to the compressed gas storage tank 8. First chamber 6 has a first volume corresponding to its internal space or capacity. A second chamber 9 is fluidly coupled to the compressed gas storage tank 8 and to the first chamber 6. A gas line 19 fluidly connects the first and second chambers.

Second chamber 9 has a second volume corresponding to its internal space or capacity. The second volume of second chamber 9 is greater than the first volume of first chamber 6. For example, the second volume of second chamber 9 may be multiple or many times greater than the first volume of first chamber 6. Second chamber 9 may have a vent 18.

Unlike the embodiment shown in FIG. 1-5, in the embodiment shown in FIG. 6-10, first chamber 6 and second chamber 9 are not arranged in parallel, with a common piston extending through both chambers. Rather, as shown the smaller first chamber 6 and the larger second chamber 9 may be offset vertically and/or laterally and are fluidly connected by a gas line 19.

As shown schematically, a first fill valve 10 is disposed between the compressed gas storage tank 8 and the first chamber 6 and is configured to selectively allow the compressed gas to flow from the compressed gas storage tank 8 to the first chamber 6. First fill valve 10 may be a ball valve or any other valve suitable for selectively allowing compressed gas to flow from the compressed gas storage tank 8 to the first chamber 6. A check valve 12 may be disposed between the first fill valve 10 and the first chamber 6.

A second fill valve 11 is disposed between compressed gas storage tank 8 and the second chamber 9 and is configured to configured to selectively allow the compressed gas to flow from the compressed gas storage tank 8 to the second chamber 9. Second fill valve 11 may be a ball valve or any other valve suitable for selectively allowing compressed gas to flow from the compressed gas storage tank 8 to the second chamber 9.

As shown schematically in the embodiment of FIGS. 6-10, the PCP air gun 1 has a compression piston 13' movable within the second chamber 9. A sealing engagement of the compression piston 13' with the second chamber 9 may be facilitated by one or more O-rings 17' installed on the compression piston 13'.

As shown schematically in FIGS. 7-10, the compression piston 13' is operable to increase a pressure of the compressed gas in the first chamber 6 to a final first chamber pressure greater than an initial first chamber pressure by sequentially opening the first fill valve 10 with the second fill valve 11 closed to allow the compressed gas to flow from the compressed gas storage tank 8 to the first chamber 6 and achieve the initial first chamber pressure and then opening the second fill valve 11 to allow the compressed gas to flow from the compressed gas storage tank 8 to the second chamber 9, thereby displacing the compression piston 13' within the second chamber 9 and further compressing the compressed gas in the first chamber 6 to achieve the final first chamber pressure.

Figure 7:
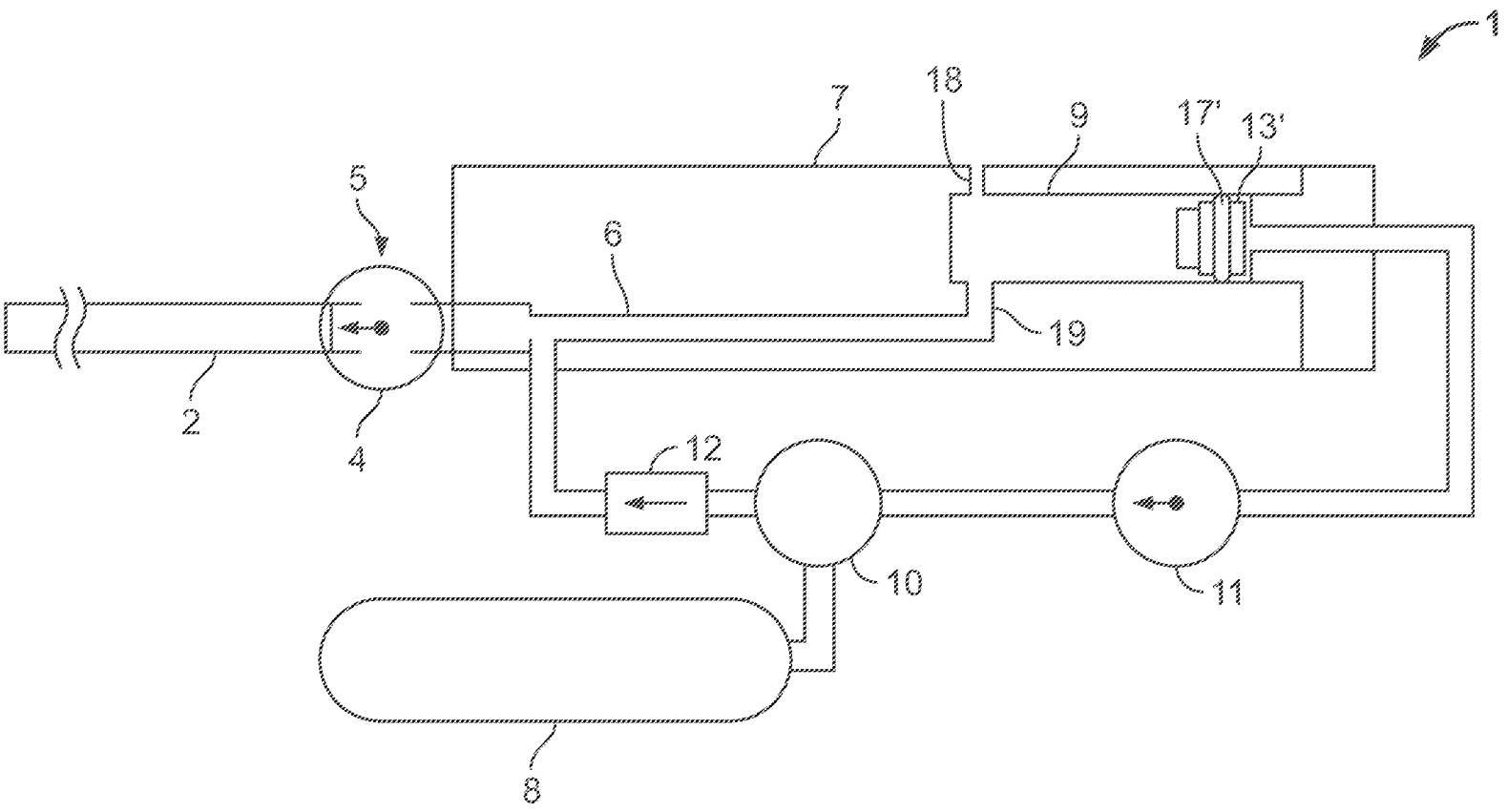
FIG. 7 is a schematic sectional view of the PCP air gun according to FIG. 6 in a post firing condition.

In particular, FIG. 7 schematically shows a PCP air gun 1 in a first condition which represents a post firing condition wherein all of the compressed gas from the first chamber 6 has been released out of the barrel 2 for firing a projectile 3. Both firing valve 4 and second fill valve 11 are in an open position or state, allowing compressed gas to flow therethrough.

Figure 8:
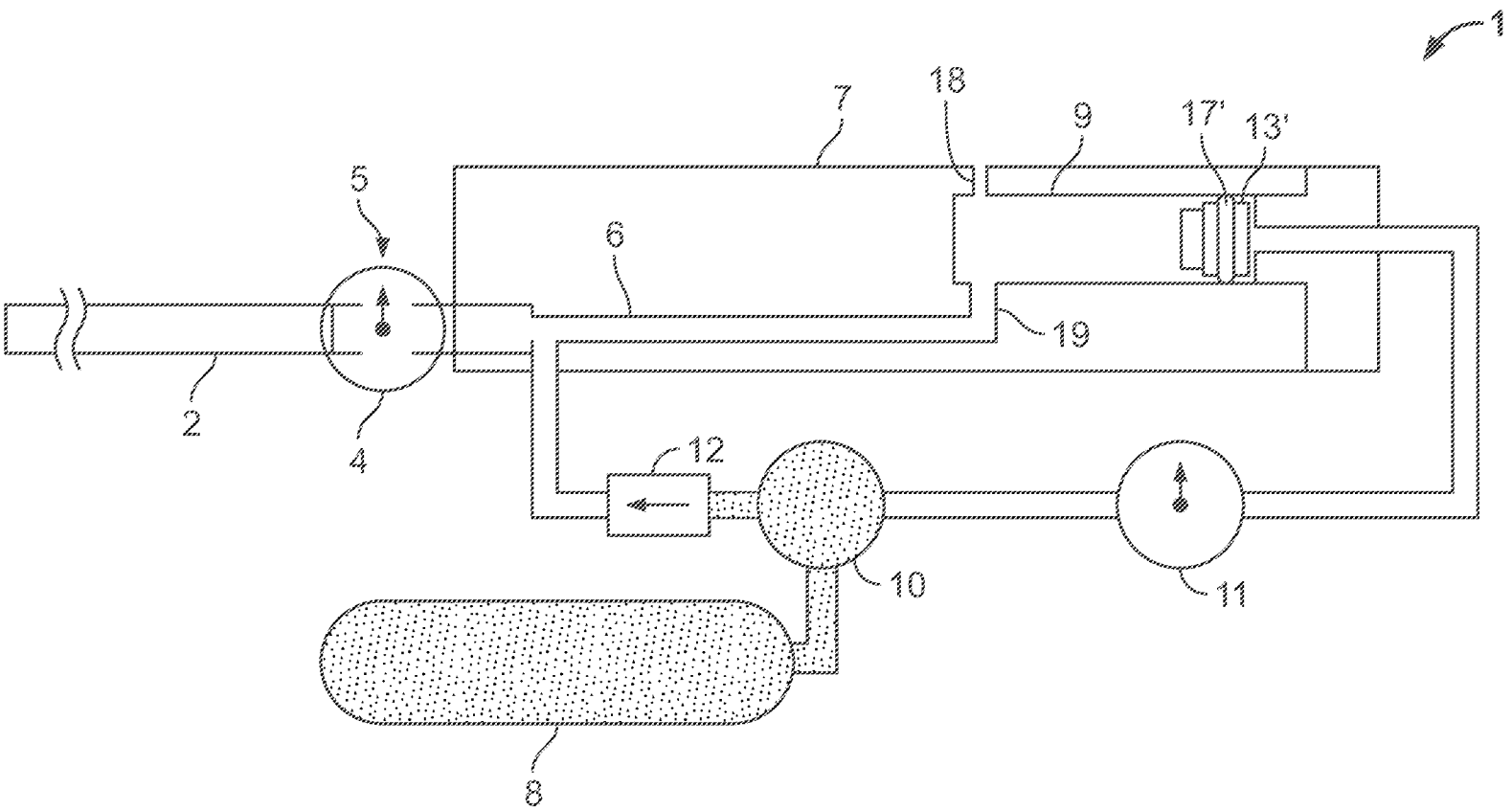
FIG. 8 is a schematic sectional view of the PCP air gun according to FIG. 6 in a condition preparing to fire a projectile.

FIG. 8 schematically shows the PCP air gun 1 in a second condition which represents a condition in preparation for firing a projectile 3. The firing valve 4 is in a closed position or state. The first fill valve 10 is opened while the second fill valve 11 remains closed, thereby allowing compressed gas to flow from the compressed gas storage tank 8 into the smaller, first chamber 6. At this time, no compressed gas is supplied to the larger, second chamber 9.

Figure 9:
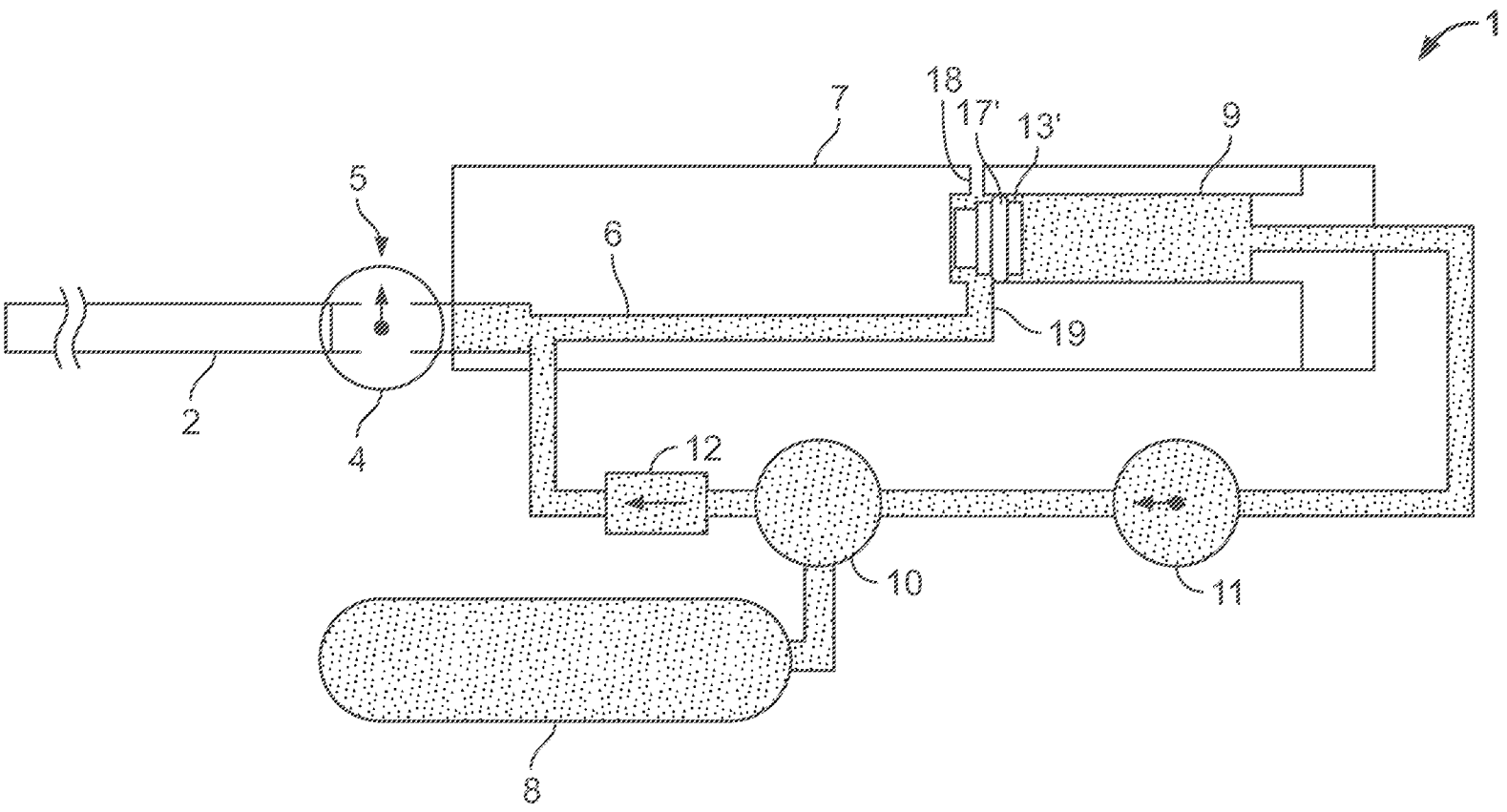
FIG. 9 is a schematic sectional view of the PCP air gun according to FIG. 6 in a subsequent condition preparing to fire the projectile.

FIG. 9 schematically shows the PCP air gun 1 in a third condition which represents a subsequent condition in preparation for firing projectile 3. Second fill valve 11 is opened, thereby allowing compressed gas to flow from the compressed storage tank 8 into the larger, second chamber 9. Because the volume of the second chamber 9 is larger, and even many times larger, than the volume of the first chamber 6, the movement of the compression piston 13' further compresses the compressed gas in the first chamber 6 to achieve a final first chamber pressure which is greater than the initial first chamber pressure as provided by the compressed gas storage tank 8. Thus, the initial first chamber pressure is present in the condition illustrated in FIG. 8, wherein the final first chamber pressure is present in the condition illustrated in FIG. 9.

Figure 10:
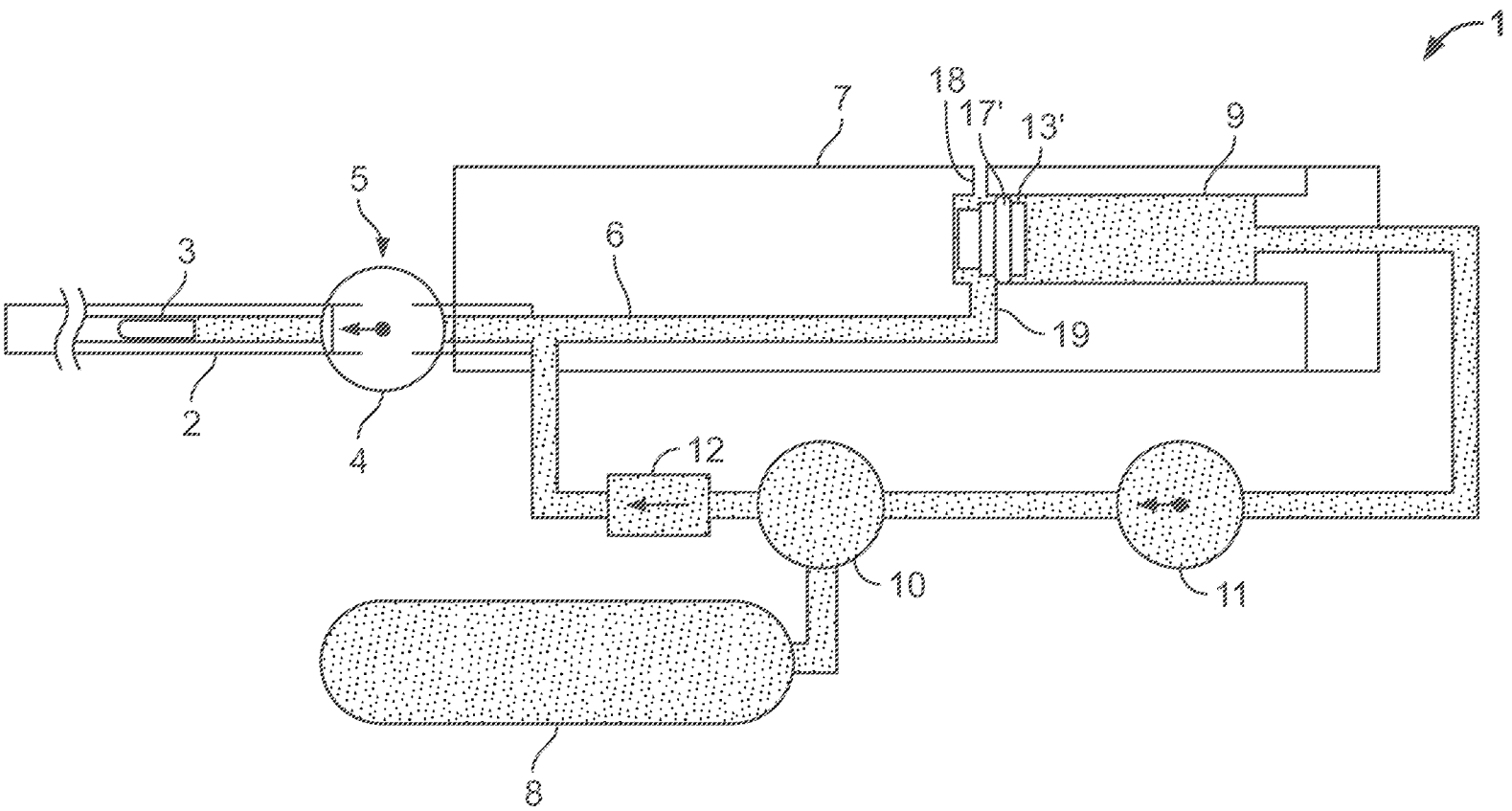
FIG. 10 is a schematic sectional view of the PCP air gun according to FIG. 6 in a condition wherein a trigger has actuated a firing valve to fire the projectile.

FIG. 10 schematically shows the PCP air gun 1 in a fourth condition which represents a firing condition in which the trigger assembly 5 has been pulled, causing the firing valve 4 to open. This allows the compressed and boosted gas from the first chamber 6 to be released out of the barrel 2, followed by the compressed gas in the second chamber 9, which propels projectile 3 out of the barrel 2 at high velocity. Following the fourth condition illustrated schematically in FIG. 10, the PCP air gun 1 returns to the first condition illustrated schematically in FIG. 7.

Although a number of embodiments of the present invention have been shown and described, it is obvious that many changes and modifications may be made thereunto without departing from the spirit and scope of the invention.

What is claimed is:

1. A pre-charged pneumatic air gun comprising:

a barrel;

a firing valve disposed in the barrel;

a trigger assembly configured to actuate the firing valve;

a compressed gas storage tank containing a compressed gas;

a first chamber fluidly coupled to the barrel and to the compressed gas storage tank and having a first volume;

a second chamber fluidly coupled to the compressed gas storage tank and having a second volume greater than the first volume of the first chamber;

a first fill valve configured to selectively allow the compressed gas to flow from the compressed gas storage tank to the first chamber;

a second fill valve configured to selectively allow the compressed gas to flow from the compressed gas storage tank to the second chamber; and a compression piston movable within the first chamber and the second chamber, the compression piston comprising a first portion sealingly engaged with the first chamber and a second portion sealingly engaged with the second chamber;

wherein the compression piston is operable to increase a pressure of the compressed gas in the first chamber to a final first chamber pressure greater than an initial first chamber pressure by sequentially opening the first fill valve with the second fill valve closed to allow the compressed gas to flow from the compressed gas storage tank to the first chamber and achieve the initial first chamber pressure and then opening the second fill valve to allow the compressed gas to flow from the compressed gas storage tank to the second chamber, thereby displacing the compression piston and further compressing the compressed gas in the first chamber to achieve the final first chamber pressure.

2. The pre-charged pneumatic air gun according to claim 1, wherein the firing valve comprises a ball valve.

3. The pre-charged pneumatic air gun according to claim 1, wherein the second fill valve comprises a ball valve.

4. The pre-charged pneumatic air gun according to claim 1, further comprising a check valve disposed between the first fill valve and the first chamber.

5. The pre-charged pneumatic air gun according to claim 1, further comprising a vent fluidly coupled to the second chamber.

6. The pre-charged pneumatic air gun according to claim 1, further comprising a first O-ring disposed on the first portion of the compression piston and a second O-ring disposed on the second portion of the compression piston.

7. A pre-charged pneumatic air gun comprising:

a barrel;

a firing valve disposed in the barrel;

a trigger assembly configured to actuate the firing valve;

a compressed gas storage tank containing a compressed gas;

a first chamber fluidly coupled to the barrel and to the compressed gas storage tank and having a first volume;

a second chamber fluidly coupled to the compressed gas storage tank and to the first chamber and having a second volume greater than the first volume of the first chamber;

a first fill valve configured to selectively allow the compressed gas to flow from the compressed gas storage tank to the first chamber;

a second fill valve configured to selectively allow the compressed gas to flow from the compressed gas storage tank to the second chamber;

a compression piston movable within the second chamber;

wherein the compression piston is operable to increase a pressure of the compressed gas in the first chamber to a final first chamber pressure greater than an initial first chamber pressure by sequentially opening the first fill valve with the second fill valve closed to allow the compressed gas to flow from the compressed gas storage tank to the first chamber and achieve the initial first chamber pressure and then opening the second fill valve to allow the compressed gas to flow from the compressed gas storage tank to the second chamber, thereby displacing the compression piston and further compressing the compressed gas in the first chamber to achieve the final first chamber pressure.

8. The pre-charged pneumatic air gun according to claim 7, wherein the firing valve comprises a ball valve.

9. The pre-charged pneumatic air gun according to claim 7, wherein the second fill valve comprises a ball valve.

10. The pre-charged pneumatic air gun according to claim 7, further comprising a check valve disposed between the first fill valve and the first chamber.

11. The pre-charged pneumatic air gun according to claim 7, further comprising a vent fluidly coupled to the second chamber.

12. The pre-charged pneumatic air gun according to claim 7, further comprising an O-ring disposed the compression piston.

* * * * *